United States Patent [19]

Davitt et al.

[11] 4,419,154

[45] Dec. 6, 1983

[54] DELAY COMPOSITION FOR DETONATORS

[75] Inventors: Alan L. Davitt, Brownsburg; Kenneth A. Yuill, Alfred, both of Canada

[73] Assignee: CXA Ltd/CXA LTEE, North York, Canada

[21] Appl. No.: 264,280

[22] Filed: May 18, 1981

[30] Foreign Application Priority Data

Dec. 17, 1980 [CA] Canada ..... 366968

[51] Int. Cl.[3] ..... C06B 33/12

[52] U.S. Cl. ..... 149/40; 149/21; 149/37

[58] Field of Search ..... 149/37, 21, 40

[56] References Cited

U.S. PATENT DOCUMENTS 2,586,959 2/1952 Kerr et al. ..... 149/37

4,008,109 2/1977 Norton ..... 149/37

*Primary Examiner*—Stephen J. Lechert, Jr.

[57] ABSTRACT

An improved pyrotechnic delay composition of intermediate to slow burning time is provided for use in both electric and non-electric blasting caps. The composition comprises a mixture of barium sulphate and silicon to which may optionally be added a proportion of red lead oxide. The composition is characterized by the basence of any carcinogenic properties and is not water soluble.

5 Claims, 2 Drawing Figures

DELAY COMPOSITION FOR DETONATORS

Figure 1:
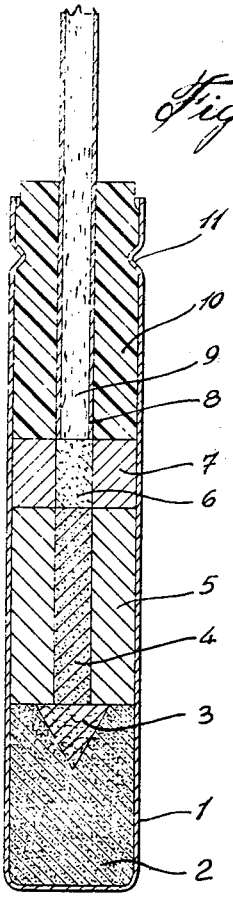

This invention relates to a novel pyrotechnic delay composition characterized by low toxicity, moisture resistance and uniform burn rate. In particular, the invention relates to a delay composition of intermediate to slow-burning time range for use in both non-electric and electric blasting caps.

Delay detonators, both non-electric and electric, are widely employed in mining, quarrying and other blasting operations in order to permit sequential initiation of the explosive charges in a pattern of boreholes. Delay or sequential initiation of shotholes is effective in controlling the fragmentation and throw of the rock being blasted and, in addition, provides a reduction in ground vibration and in air blast noise.

Modern commercial delay detonators, whether non-electric or electric, comprise a metallic shell closed at one end which shell contains in sequence from the closed end a base charge of a detonating high explosive, such as for example, PETN and an above adjacent, primer charge of a heat-sensitive detonable material, such as for example, lead azide. Adjacent the heat-sensitive material is an amount of a deflagrating or burning composition of sufficient quantity to provide a desired delay time in the manner of a fuse. Above the delay composition is an ignition charge adapted to be ignited by an electrically heated bridge wire or, alternatively, by the heat and flame of a low energy detonating cord or shock wave conductor retained in the open end of the metallic shell.

A large number of burning delay compositions comprising mixtures of fuels and oxidizers are known in the art. Many are substantially gasless compositions; that is, they burn without evolving large amounts of gaseous by-products which would interfere with the functioning of the delay detonator. In addition to an essential gasless requirement, delay compositions are also required to be safe to handle, from both an explosive and health viewpoint, they must be resistant to moisture and not deteriorate over periods of storage and hence change in burning characteristics, they must be simply compounded and economical to manufacture and they must be adaptable for use in a wide range of delay units within the limitations of space available inside a standard detonator shell. The numerous delay compositions of the prior art have met with varying degrees of success in use and application. Some of the prior art compositions contain ingredients which are recognized as carcinogenic. Other compositions contain ingredients which are soluble in water which may lead to deterioration of the composition in a moist environment. For example, one widely known delay composition comprising a mixture of powdered tungsten metal, particulate potassium perchlorate and barium chromate and diatomaceous earth, contains both water soluble material (potassium perchlorate) and a carcinogen (barium chromate). Another known type of delay composition consists of a mixture of antimony and potassium permanaganate or a mixture of zinc, antimony and potassium permanganate. These compositions, because they contain a water-soluble salt oxidizer, tend to deteriorate in hot, moist storage or use environments. As a result, detonators containing such water-soluble materials must be constructed to positively exclude any moist atmosphere thus imposing problems in manufacture.

The present invention provides a pyrotechnic delay composition of intermediate to slow burning time which composition contains no recognized carcinogen or any water-soluble material. By "intermediate to slow burning time" is meant a burning time of from about 400 to about 3200 milliseconds per centimeter of length.

In accordance with the invention, an improved pyrotechnic delay composition is provided for use in a delay blasting cap assembly which comprises from 45 to 70% by weight of barium sulphate and from 30 to 55% by weight of silicon.

Figure 2:
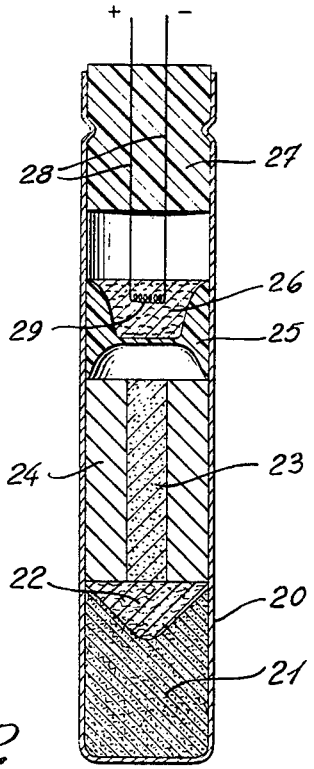

The inventio may be more clearly understood by reference to the accompanying drawing which illustrates in FIG. 1 a non-electric delay detonator and in FIG. 2, an electric delay detonator, showing the position therein of the delay composition of the invention.

With reference to FIG. 1, 1 designates a metal tubular shell closed at its bottom end and having a base charge of explosive 2 pressed or cast therein. 3 represents a primer charge of heat-sensitive explosive. The delay charge or composition of the invention is shown at 4 contained in drawn lead tube or carrier 5. Surmounting delay charge 4 is ignition charge 6 contained in carrier 7. Above ignition charge 6 is the end of a length of inserted low energy detonating cord 8 containing explosive core 9. Detonating cord 8 is held centrally and securely in tube 1 by means of closure plug 10 and crimp 11. When detonating cord 8 is set off at its remote end (not shown) heat and flame ignites ignition charge 6, in turn, igniting delay composition 4. Composition 4 burns down to detonate primer 3 and base charge 2.

With reference to FIG. 2, a tubular metal shell 20 closed at its bottom end is shown containing a base charge of explosive 21. A primer charge 22 is indented into the upper surface of charge 21. Above charger 21 and primer 22 and in contact therewith is delay composition 23 contained within a swaged and drawn lead tube or carrier 24. Spaced above delay charge 23 is a plastic cup 25 containing an ignition material charge 26, for example, a red lead/boron mixture. The upper end of shell 20 is closed by means of plug 27 through which pass lead wires 28 joined at their lower ends by resistance wire 29 which is embedded in ignition charge 26. When current is applied to wire 29 through leads 28, charge 26 is ignited. Flame from ignited charge 26 ignites delay composition 23 which in turn sets off primer 22 and explosive 21.

The invention is illustrated with reference to several series of tests summarized in the following Examples and Tables.

EXAMPLES 1–8

A number of delay compositions were made by intimately mixing together different proportions of barium sulphate and powdered silicon. The specific surface area of barium sulphate was 0.81 $m^2/g$ while the specific surface area of silicon was 8.40 $m^2/g$. The mixtures were prepared by vigorous mechanical stirring of the ingredients in slurry form utilizing water as the liquid vehicle. After mixing, the slurry was filtered under vacuum and the resulting filter cake was dried and sieved to yield a reasonably free-flowing powder. Delay elements were made by loading lead tubes with these compositions, drawing these tubes through a series of dies to a final diameter of about 6.5 mm and cutting the resultant rod into elements of length 25.4 mm. The delay times of these elements, when assembled into non-electric detonators initiated by NONEL (Reg. TM) shock wave conductor, were measured. Delay time data are given in Table I below while the sensitivities of some of these compositions to friction, impact and electrostatic discharge are shown in Table II below.

TABLE I

| Example | Composition $BaSO_4$:Si[1] | Length of Delay Element (mm) | Number of Detonators Tested |
|---|---|---|---|
| 1 | 70:30 | 25.4 | 20[2] |
| 2 | 64:36 | 25.4 | 20[2] |
| 3 | 62:38 | 25.4 | 20[2] |
| 4 | 60:40 | 25.4 | 20[2] |
| 5 | 58:42 | 25.4 | 20[2] |
| 6 | 56:44 | 25.4 | 20[2] |
| 7 | 50:50 | 25.4 | 20[3] |
| 8 | 45:55 | 25.4 | 20[2] |

| | Delay Time (milliseconds) | | | | |
|---|---|---|---|---|---|
| Example | Mean | Min. | Max. | Scatter | Coefficient of Variation[4] (%) |
| 1 | 3385 | 3224 | 3541 | 317 | 2.40 |
| 2 | 5062 | 4834 | 5184 | 350 | 1.77 |
| 3 | 5325 | 5172 | 5476 | 304 | 1.71 |
| 4 | 5681 | 5527 | 5786 | 259 | 1.36 |
| 5 | 5936 | 5839 | 6003 | 164 | 0.66 |
| 6 | 5642 | 5529 | 5765 | 236 | 0.98 |
| 7 | 5089 | 4966 | 5360 | 394 | 1.95 |
| 8 | 4466 | 4256 | 4856 | 600 | 2.99 |

Notes:
[1]$BaSO_4$ specific surface area 0.81 $m^2/g$; Si specific surface area 8.40 $m^2/g$.
[2]Denotes detonators which incorporated a 12.7 mm long red lead-silicon igniter element and a 6.35 long red lead-silicon igniter element. Delay times quoted include delay time contribution of these two igniter elements, nominally 95 milliseconds.
[3]Denotes detonators which incorporated a 12.7 mm long red lead-silicon igniter element and a 6.35 mm long red lead-silicon-Ottawa sand ($SiO_2$) igniter element. Delay times quoted above include delay time contribution of these two igniter elements, nominally 160 milliseconds.
[4]Delay time coefficient of variation is delay time standard deviation expressed as a percentage of mean delay time.

TABLE II

| Composition $BaSO_4$:Si[1] | Impact[2] Min. Ignition Height (cm) | Friction[3] Min. Ignition Height (cm) | Electrostatic Discharge[4] Min. Ignition Energy (mJ) |
|---|---|---|---|
| 70:30 | >139.7 | >83.8 | >256.5 |
| 65:35 | >139.7 | >83.8 | >256.5 |
| 60:40 | >139.7 | >83.8 | >256.5 |
| 55:45 | >139.7 | >83.8 | >256.5 |
| 50:50 | >139.7 | >83.8 | >256.5 |
| 45:55 | >139.7 | >83.8 | >256.5 |

Notes:
[1]$BaSO_4$ specific surface area 0.81 $m^2/g$; Si specific surface area 8.40 $m^2/g$.
[2]In impact test, mass of fall-hammer (steel) 5.0 kg. Samples tested in copper/zinc (90/10) cup.
[3]In friction test, mass of torpedo (with aluminum head) 2.898 kg. Samples tested on aluminum blocks.
[4]Discharge from 570 pF capacitor.

EXAMPLE 9

The relationship between means delay time and length of delay element was established for a barium sulphate-silicon 58:42 composition. Again, the tests were performed using non-electric detonators initiated by NONEL (Reg. TM). Results are shown in Table III below.

TABLE III

| Example | Composition $BaSO_4$:Si[1] | Length (L) of Delay Element (mm) | Number of Detonators Tested |
|---|---|---|---|
| 9 | 58:42 | 6.35 | 20[2] |
| | | 12.7 | 20[2] |
| | | 25.4 | 20[2] |

| Delay Time (milliseconds) | | | | | |
|---|---|---|---|---|---|
| Mean | Min. | Max. | Scatter | Coefficient of Variation (%) | Relation between Mean Delay Time (T) and Delay Element Length (L) |
| 1449 | 1381 | 1515 | 134 | 2.26 | T = 234.7 L − 8.0 ms (Correlation coefficient 0.9998) |
| 3022 | 2934 | 3104 | 170 | 1.24 | |
| 5936 | 5839 | 6003 | 164 | 0.66 | |

Notes:
[1]$BaSO_4$ specific surface area 0.81 $m^2/g$; Si specific surface area 8.40 $m^2/g$.
[2]Each detonator incorporated a 12.7 mm long red lead-silicon igniter element and a 6.35 mm long red lead-silicon igniter element. Delay times quoted include delay time contribution of these two igniter elements, nominally 95 milliseconds.

From the results shown in Table III, it can be seen that a strong linear relationship exists between mean delay time and length of barium sulphate-silicon delay element. This characteristic is important in manufacturing processes that utilize drawn lead delay elements, as it affords control of nominal delay times by simple manipulation of element cutting lengths.

EXAMPLE 10

A evaluation of the low-temperature timing performance of barium sulphate-silicon compositions was made by subjecting non-electric detonators containing a $BaSO_4$-Si 58:42 pyrotechnic mixture to a temperature of −45° C. for a period of 24 hours. The detonators were subsequently fired at that temperature by means of NONEL (Reg. TM) shock wave conductor and their delay times were noted. Timing results are given in Table IV below.

TABLE IV

| Example | Composition $BaSO_4$:Si[1] | Test Temperature (°C.) | Number of Detonators Tested/Number Fired |
|---|---|---|---|
| 10 | 58:42 | 20 | 20/20[2] |
| | 58:42 | −45 | 15/15[2] |

| Delay Time (milliseconds) | | | | | | |
|---|---|---|---|---|---|---|
| Mean | Min. | Max. | Scatter | Coefficient of Variation (%) | % Change in Delay Time (20° C. to −45° C.) | % Change in Delay Time/°C. |
| 3022 | 2934 | 3104 | 170 | 1.24 | 3.84 | 0.059 |
| 3138 | 3068 | 3218 | 150 | 1.48 | | |

Notes:
[1]$BaSO_4$ specific surface area 0.81 $m^2/g$; Si specific surface area 8.40 $m^2/g$.
[2]Each detonator had a 12.7 mm long red lead-silicon igniter element, a 6.35 mm long red lead-silicon igniter element and a 6.35 mm long barium sulphate-silicon delay element. Delay times quoted include delay time contributions of igniter elements, nominally 95 milliseconds.

As seen from the results in Table IV, the temperature coefficient of the $BaSO_4$:Si 58:42 composition over the temperature range −45° C. to +20° C. is 0.059 percent per degree C. Also, it can be noted that no failure occurred in these low-temperature firing tests.

EXAMPLE 11

In order to assess the effect of the specific surface area of silicon on the delay time characteristics of barium sulphate-silicon composition, three mixtures, each consisting of $BaSO_4$-Si in the mass ratio 58:42, were prepared. Silicon samples of specific surface area 8.40, 7.20 and 6.05 $m^2/g$ were used in the preparation of the compositions under test. The delay times of these compositions were measured in assembled NONEL (Reg. TM) initiated non-electric detonators. The results which were obtained are summarized in Table V, below, where it can be seen that as the fuel specific surface area is decreased the greater is the delay time of the composition.

TABLE V

| Example | Composition $BaSO_4$:Si[1] | Specific Surface Area of Silicon ($m^2/g$) | Length of Delay Element (mm) | Number of Detonators Tested |
|---|---|---|---|---|
| 11 | 58:42 | 8.40 | 25.4 | 20[2] |
| | 58:42 | 7.20 | 25.4 | 20[2] |
| | 58:42 | 6.05 | 25.4 | 20[2] |

| Delay Time (milliseconds) | | | | |
|---|---|---|---|---|
| Mean | Min. | Max. | SCatter | Coefficient of Variation (%) |
| 5936 | 5839 | 6003 | 164 | 0.66 |
| 6603 | 6453 | 6749 | 296 | 1.26 |
| 8065 | 7495 | 8351 | 856 | 2.61 |

Notes:
[1]$BaSO_4$ specific surface area 0.81 $m^2/g$.
[2]Each detonator incorporated a 12.7 mm red lead-silicon igniter element and a 6.35 mm red lead-silicon igniter element. Delay times quoted include delay time contribution of these two igniter elements, nominally 95 milliseconds.

EXAMPLE 12

The suitability for use in electric detonators of one of the compositions of the invention was determined. The oxidant-fuel combination which was evaluated was 60:40 $BaSO_4$-Si by mass. Barium sulphate of specific surface area 0.81 $m^2/g$ and silicon of specific surface area 8.40 $m^2/g$ were employed. Electric detonators, each having a delay train consisting of a 6.35 mm long red lead-silicon-Ottawa sand ($SiO_2$) igniter element superimposed on a 25.4 mm long barium sulphate-silicon delay element, were assembled and fired. Statistical data on the timing performance of these detonators is condensed in Table VI. Included in Table VI, for comparison, are the corresponding timing results obtained for the same mixture in non-electric, NONEL (Reg. TM) inidiated detonators.

TABLE VI

| Example | Composition $BaSO_4$:Si[1] | Detonator Type | Length of Delay Element (mm) | Number of Detonators Tested | Delay Time (milliseconds) Mean | Min. | Max. | Scatter | Coefficient of Variation (%) |
|---|---|---|---|---|---|---|---|---|---|
| 12 | 60:40 | Non-electric | 25.4 | 20[2] | 5681 | 5527 | 5786 | 259 | 1.36 |
| | 60:40 | Electric | 25.4 | 20[3] | 5075 | 4905 | 5173 | 268 | 1.33 |

Notes:
[1]$BaSo_4$ specific surface area 0.81 $m^2/g$; Si specific surface area 8.40 $m^2/g$.
[2]Denotes detonators which incorporated a 12.7 mm long red lead-silicon igniter element and a 6.35 mm long red lead-silicon igniter element. Delay times quoted include delay time contribution of these two igniter elements, nominally 95 milliseconds.
[3]Denotes detonators which incorporated a 6.35 mm long red lead-silicon-Ottawa sand ($siO_2$) igniter element. Delay times quoted include delay time contribution of this igniter element, nominally 85 milliseconds.

The barium sulphate/silicon delay composition of the invention may in some cases, advantageously contain a proportion of red lead oxide. The inclusion of red lead oxide has the effect of somewhat speeding up the burning time of the composition without any adverse effect on either toxicity or water solubility. Typically, such a three-component composition comprises from 15 to 60% by weight of barium sulphate, from 25 to 75% by weight of red lead oxide and from 5 to 40% by weight of silicon. While the two-component delay composition of the invention comprising barium sulphate/silicon mixture provides a burning time of from about 1300 to 3200 milliseconds per centimeter of length, the three-component barium sulphate/silicon/red lead oxide mixture provides a somewhat higher burn rate of from about 400 to 2750 milliseconds per centimeter of length.

The further aspect of the invention comprising the addition of red lead oxide to the barium sulphate/silicon delay composition is illustrated with reference to several series of tests which are summarized in the following Examples and Tables.

EXAMPLES 13–19

A series of seven delay compositions comprising barium sulphate/red lead oxide/silicon mixtures were compounded in which the silicon proportion was varied from 5.7 percent to 35.0 percent by weight of the total composition while the ratio of oxidants barium sulphate/red lead oxide was held constant at 0.80. The effect of these formulation changes on composition delay time was measured. In the formulations the specific surface area of silicon was 1.79 $m^2/g$; barium sulphate and red lead oxide had specific surface areas of 0.81 $m^2/g$ and 0.73 $m^2/g$ respectively. The mixtures were prepared by vigorous mechanical stirring of the ingredients in slurry form utilizing water as the liquid vehicle. After mixing, the slurry was filtered under vacuum and the resulting filter cake was dried and sieved to yield a reasonably free-flowing powder. Delay elements were made by loading lead tubes with the compositions, drawing the lead tubes through a series of dies of decreasing diameter to a final diameter of about 6.5 mm, and cutting the resultant rod into elements. Non-electric detonators initiated by means of NONEL (Reg. TM) shock wave conductor were loaded with the delay elements, fired and the delay times noted. A summary of the delay times is given in Table VII, below.

TABLE VII

| Example | Composition $BaSO_4$:$Pb_3O_4$:Si[1] | Length of delay element (mm) | Number of detonators fired | Delay time (milliseconds) Mean | Min. | Max. | Scatter | Coefficient of variation (%) |
|---|---|---|---|---|---|---|---|---|
| 13 | 41.9: 52.4: 5.7 | 25.4 | 20[2] | 7034 | 6867 | 7318 | 451 | 1.56 |
| 14 | 41.5: 51.8: 6.7 | 25.4 | 20[2] | 5324 | 5186 | 5423 | 237 | 1.19 |
| 15 | 40.0: 50.0: 10.0 | 25.4 | 20[3] | 1779 | 1739 | 1815 | 76 | 1.18 |
| 16 | 37.8: 47.2: 15.0 | 25.4 | 20[3] | 1106 | 1078 | 1148 | 70 | 1.63 |
| 17 | 35.6: 44.4: 20.0 | 25.4 | 20[3] | 1365 | 1324 | 1418 | 94 | 1.83 |

TABLE VII-continued

| Example | Composition $BaSO_4$:$Pb_3O_4$:Si[1] | Length of delay element (mm) | Number of detonators fired | Delay time (milliseconds) Mean | Min. | Max. | Scatter | Coefficient of variation (%) |
|---|---|---|---|---|---|---|---|---|
| 18 | 31.1: 38.9: 30.0 | 25.4 | 20[3] | 2541 | 2492 | 2593 | 101 | 1.13 |
| 19 | 28.9: 36.1: 35.0 | 25.4 | 20[3] | 4155 | 4010 | 4348 | 338 | 1.75 |

Notes:
[1]Silicon of specific surface area 1.79 $m^2/g$
[2]Denotes detonators which incorporated a 12.7 mm long red lead-silicon igniter element and a 6.35 mm long red lead-silicon igniter element. Delay times quoted include delay time contribution of these two igniter elements, nominally 95 milliseconds.
[3]Denotes detonators which incorporated a 12.7 mm long red lead-silicon igniter element and a 6.35 mm long red lead-silicon-Ottawa sand ($SiO_2$) igniter element. Delay times quoted above include delay time contribution of these two igniter elements, nominally 160 milliseconds.

EXAMPLES 20–27

In a series of eight tests, formulations comprising barium sulphate/red lead oxide/silicon mixtures were compounded in the same manner as described in Examples 13–19 in which the silicon proportion was held constant at 6.7 percent by weight while the ratio of oxidants barium sulphate/red lead oxide was varied from 0.26 to 0.90. Again, the specific surface areas of barium sulphate, red lead oxide and silicon were 0.81, 0.73 and 1.79 $m^2/g$ respectively. The delay time characteristics of the compositions, tested in non-electric NONEL initiated detonators, are shown in Table VIII. It should be noted that a control sample of composition containing no barium sulphate was included in these tests. The performance of this control sample, containing of $Pb_3O_4$/Si in the ratio 93.3:6.7, is also shown in Table VIII.

The data shown in Table VIII demonstrates that in the case of $BaSO_4$/$Pb_3O_4$/Si compositions in which the proportion of silicon is fixed, any increase in the proportion of barium sulphate (at the expense of red lead oxide) has the effect of retarding the delay time of the composition.

TABLE VIII

| Example | Composition $BaSO_4$:$Pb_3O_4$:Si(1) | Length of delay element (mm) | Number of detonators fired |
|---|---|---|---|
| 20 | 44.2:49.1:6.7 | 25.4 | 10(2) |
| 21 | 42.2:51.1:6.7 | 25.4 | 10(2) |
| 22 | 40.7:52.6:6.7 | 25.4 | 20(3) |
| 23 | 37.2:56.1:6.7 | 25.4 | 20(3) |
| 24 | 34.2:59.1:6.7 | 25.4 | 20(3) |
| 25 | 29.2:64.1:6.7 | 25.4 | 20(3) |
| 26 | 24.2:69.1:6.7 | 25.4 | 20(3) |
| 27 | 19.2:74.1:6.7 | 25.4 | 20(3) |
| — | nil:93.3:6.7 | 25.4 | 20(3) |

| Example | Delay time (milliseconds) Mean | Min. | Max. | Scatter | Coefficients of variation (%) |
|---|---|---|---|---|---|
| 20 | 7454 | 7329 | 7565 | 236 | 0.99 |
| 21 | 6114 | 6019 | 6290 | 271 | 1.19 |
| 22 | 4941 | 4894 | 4988 | 94 | 0.50 |
| 23 | 2844 | 2773 | 2916 | 143 | 1.59 |
| 24 | 2132 | 2096 | 2169 | 73 | 0.82 |
| 25 | 1642 | 1621 | 1658 | 37 | 0.56 |
| 26 | 1393 | 1380 | 1416 | 36 | 0.62 |
| 27 | 1202 | 1190 | 1211 | 21 | 0.45 |
| — | 449 | 406 | 473 | 67 | 4.60 |

Notes:
(1)Specific surface area of silicon 1.79 $m^2/g$
(2)Denotes detonators which incorporated a 12.7 mm long red lead-silicon igniter element and a 6.35 mm long red lead-silicon-Ottawa sand ($SiO_2$) igniter element. Delay times quoted include delay time contribution of these two igniter elements, nominally 160 milliseconds.
(3)Denotes detonators which incorporated a 12.7 mm long red lead-silicon igniter element and a 6.35 mm long red lead-silicon igniter element. Delay times quoted include delay time contribution of these two igniter elements, nominally 95 milliseconds.

EXAMPLE 28

The effect of the specific surface area of silicon on the mean delay time of barium sulphate-red lead oxide-silicon composition was assessed. The formulation selected was $BaSO_4$/$Pb_3O_4$/Si in the ratio 44.2:49.1:6.7 respectively by weight. Silicon samples of specific surface areas 1.79, 3.71 and 8.40 $m^2/g$ were used to make the compositions under test. The results which were obtained are condensed in Table IX, where it can be seen that the mean delay time decreases as silicon specific surface area is increased.

TABLE IX

| Example | Composition $BaSO_4$:$Pb_3O_4$:Si | Specific Surface Area of Silicon | Length of Delay Element (mm) |
|---|---|---|---|
| 28 | 44.2:49.1:6.7 | 1.79 | 25.4 |
| | 44.2:49.1:6.7 | 3.71 | 25.4 |
| | 44.2:49.1:6.7 | 8.40 | 25.4 |

| Example | Number of Detonators Fired | Delay Time (milliseconds) Mean | Min. | Max. | Scatter | Coefficient of Variation % |
|---|---|---|---|---|---|---|
| 28 | 10(1) | 7454 | 7329 | 7565 | 236 | 0.99 |
| | 20(2) | 1535 | 1492 | 1568 | 76 | 1.24 |
| | 20(2) | 753 | 746 | 761 | 15 | 0.55 |

Notes:
(1)Denotes detonators which incorporated 12.7 mm long red lead-silicon igniter element and a 6.35 mm long red lead-silicon-Ottawa sand ($SiO_2$) igniter element. Delay times quoted include delay time contribution of these igniter elements, nominally 160 milliseconds.
(2)Denotes detonators which incorporated a 12.7 mm long red lead-silicon igniter element and a 6.35 mm long red lead-silicon igniter element. Delay times quoted include delay time contribution of these igniter elements, nominally 95 milliseconds.

EXAMPLES 29 and 30

The relationships between mean delay time and delay element length were determined for two of the compositions of the invention namely $BaSO_4$/$Pb_3O_4$/Si in the ratio 29.2:64.1:6.7 and also in the ratio 41.5:51.8:6.7 by weight. Lead-drawn delay elements of lengths 6.35, 12.7, 25.4 and 50.8 mm made with these compositions were assembled into non-electric, NONEL (Reg. TM) initiated detonators, subsequently fired and the delay times noted. Results are shown in Table X. From these results it can be seen that, for the two formulations tested, strong linear relationships exist between mean delay time and delay element length. This characteristic is important in manufacturing processes which utilize lead-drawn delay elements, as it affords control of nominal delay times by simple manipulation of element cutting lengths.

TABLE X

| Example | Composition $BaSO_4$:$Pb_3O_4$:Si[1] | Length of (L) Delay Element (mm) | Number of Detonators Fired | Delay time (milliseconds) Mean | Min. | Max. | Scatter | Coefficient of Variation % | Relation Between Mean Delay Time (T) & Length (L) of Delay Element |
|---|---|---|---|---|---|---|---|---|---|
| 29 | 29.2:64.1:6.7 | 6.35 | 20[2] | 478 | 452 | 502 | 50 | 2.64 | T(ms) = 62.17 |
| | | 12.7 | 20[2] | 859 | 844 | 870 | 26 | 0.72 | (L) + 74.4 ms |
| | | 25.4 | 20[2] | 1646 | 1629 | 1660 | 31 | 0.57 | (Correlation co- |
| | | 50.8 | 20[2] | 3237 | 3204 | 3267 | 63 | 0.58 | efficient 0.9999) |
| 30 | 41.5:51.8:6.7 | 6.35 | 20[3] | 1134 | 1074 | 1243 | 169 | 3.51 | T(ms) = 205.5 |
| | | 12.7 | 20[3] | 2602 | 2402 | 2690 | 288 | 2.75 | (L) − 33.1 ms |
| | | 25.4 | 3 | 5392 | 5178 | 5506 | 328 | 1.57 | (Correlation co- |
| | | 50.8 | 20[3] | 10317 | 9896 | 10490 | 594 | 1.49 | efficient 0.9993) |

Notes:
[1]Specific surface area of silicon 1.79 $m^2/g$
[2]Denotes detonators which incorporated a 12.7 mm long red lead-silicon igniter element. Delay times quoted include delay time contribution of this igniter element, nominally 70 milliseconds.
[3]Denotes detonators which incorporated a 12.7 mm long red lead-silicon igniter element and a 6.35 mm long red lead-silicon-Ottawa sand ($SiO_2$) igniter element. Delay times quoted include delay time contribution of these two igniter elements, nominally 160 milliseconds.

EXAMPLES 31 and 32

An assessment of the low temperature timing performance and reliability of the $BaSO_4/Pb_3O_4/Si$ compositions of the invention was made by subjecting non-electric detonators containing two of the above mentioned pyrotechnic mixtures to a temperature of −45° C. for a period of 24hours. The detonators were subsequently fired at that temperature by means of NONEL (Reg. TM) shock wave conductor and their delay times were noted. Results are given in Table XI. It can be noted that no failure occurred in these low temperature firing tests.

TABLE XI

| Example | Composition $BaSO_4$:$Pb_3O_4$:Si(1) | Length of Delay Element (mm) | Test temp. (°C.) | Number of Detonators Fired & Tested |
|---|---|---|---|---|
| 31 | 29.2:64.1:6.7 | 25.4 | 20 | 20(2)/20(2) |
| | | 25.4 | −45 | 20(2)/20(2) |
| 32 | 41.5:51.8:6.7 | 25.4 | 20 | 20(3)/20(3) |
| | | 25.4 | −45 | 20(3)/20(3) |

| Example | Delay time (milliseconds) Mean | Min. | Max. | Scatter | Coefficient of Variation (%) |
|---|---|---|---|---|---|
| 31 | 1646 | 1629 | 1660 | 31 | 0.57 |
| | 1836 | 1800 | 1875 | 75 | 1.10 |
| 32 | 5392 | 5178 | 5506 | 328 | 1.57 |
| | 7123 | 6752 | 7319 | 567 | 2.11 |

| Example | % Change in Delay time (20° C. to −45° C.) | % Change in Delay time/°C. |
|---|---|---|
| 31 | 11.54 | 0.178 |
| 32 | 32.10 | 0.494 |

Notes:
(1)Specific surface area of silicon 1.79 $m^2/g$
(2)Denotes detonators which incorporated a 12.7 mm long red lead-silicon igniter element. Delay times quoted include delay time contribution of this igniter element, nominally 70 milliseconds.
(3)Denotes detonators which incorporated a 12.7 mm long red lead-silicon igniter element and a 6.35 mm long red lead-silicon-Ottawa sand ($SiO_2$) igniter element. Delay times quoted include delay time contribution of these two igniter elements, nominally 160 milliseconds.

EXAMPLE 33

In order to demonstrate the suitability of the composition of the present invention for use in electric detonators, the timing performance in electric detonators of a mixture of $BaSO_4/Pb_3O_4/Si$ in the weight ratio 29.2:64.1:6.7 was determined. Results are shown in Table XII. Included in Table XI for comparison, are the corresponding timing results obtained for the same mixture in non-electric, NONEL (Reg. TM) initiated detonators.

TABLE XII

| Example | Composition $BaSO_4$: | $Pb_3O_4$: | Si(1) | Detonator Type | Length of Element (mm) | Number of Detonators Tested |
|---|---|---|---|---|---|---|
| 33 | 29.2: | 64.1: | 6.7 | Non-electric | 25.4 | 20(2) |
| | 29.2: | 64.1: | 6.7 | Electric | 25.4 | 10(3) |

| Example | Delay time (milliseconds) Mean | Min. | Max. | Scatter | Coefficient Variation (%) |
|---|---|---|---|---|---|
| 33 | 1642 | 1621 | 1658 | 37 | 0.56 |
| | 1559 | 1528 | 1584 | 56 | 1.07 |

Notes:
(1)Specific surface area of silicon 1.79 $m^2/g$
(2)Denotes detonators which incorporated a 12.7 mm long red lead-silicon igniter element. Delay times quoted include delay time contribution of this igniter element, nominally 70 milliseconds.
(3)No igniter element was used in electric detonators.

The components of the novel delay composition of the invention must be in a finely divided state to insure intimate contact between the oxidants and fuel. Measured in terms of specific surface area, the barium sulphate ranges from 0.5 to 3.0 $m^2/g$, preferably 0.8 to 2.7 $m^2/g$, the red lead oxide ranges from 0.3 to 1.0 $m^2/g$, preferably from 0.5 to 0.8 $m^2/g$, and the silicon ranges from 1.4 to 10.1 $m^2/g$, preferably from 1.8 to 8.5 $m^2/g$. The oxidizers and fuel may advantageously be slurried with vigorous stirring in water as a carrier, the water removed by vacuum filtration and the filter cake dried and sieved to yield a free-flowing, finepowder ready for use.

We claim:

1. A pyrotechnic delay composition adapted for non-electric and electric delay detonators comprising from 45% to 70% by weight of particulate barium sulphate and from 30% to 55% by weight of particulate silicon.

2. An improved delay blasting detonator having a delay composition interposed between an ignition element and a primer/detonation element, said delay composition comprising 45% to 70% by weight of particulate barium sulphate and from 30% to 55% of particulate silicon.

3. A pyrotechnic delay composition as claimed in claim 1 also containing from 25% to 75% by weight of particulate red lead oxide.

4. A pyrotechnic delay composition as claimed in claim 3 comprising from 15% to 60% by weight of particulate barium sulphate, from 5% to 40% by weight of particulate silicon and from 25% to 75% by weight of particulate red lead oxide.

5. An improved delay blasting detonator having a delay composition as claimed in claim 4 interposed between an ignition element and a primer/detonation element.

* * * * *